US005326182A

United States Patent [19]

Hagstrom

[11] Patent Number: 5,326,182

[45] Date of Patent: Jul. 5, 1994

[54] RIBBON ROLL DRIVE

[75] Inventor: Erick E. Hagstrom, Plymouth, Minn.

[73] Assignee: Datamax Bar Code Products Corporation, Orlando, Fla.

[21] Appl. No.: 944,842

[22] Filed: Sep. 14, 1992

[51] Int. Cl.[5] ..... B41J 33/14

[52] U.S. Cl. ..... 400/223; 400/234; 400/249

[58] Field of Search ..... 400/223, 225, 234, 242, 400/697.1, 244, 249

[56] References Cited

U.S. PATENT DOCUMENTS 4,626,718 12/1986 Moriyama ..... 400/225
4,798,490 1/1989 Watanabe ..... 400/223
4,886,385 12/1989 Cappotto ..... 400/234
5,062,722 11/1991 Shiozaki et al. ..... 400/120
5,087,137 2/1992 Burnard et al. ..... 400/249

*Primary Examiner*—Edgar S. Burr
*Assistant Examiner*—Ren Yan
*Attorney, Agent, or Firm*—James H. Beusse; Theodore F. Neils

[57] ABSTRACT

A motor and drive mechanism having a drive hub which positively locks to a core for a ribbon roll, and a drag hub which also positively locks to a core for a ribbon roll. A ribbon roll has a core formed of concentric cylindrical shells separated from one another with a ribbon wound about the outer shell and one or more coding marks are provided on this shell to indicate both the printer control system and, to a visual observer, information specific to the ribbon.

16 Claims, 5 Drawing Sheets

RIBBON ROLL DRIVE

BACKGROUND OF THE INVENTION

This invention relates to printers and, more particularly, to drive mechanisms for rolls of ribbons used in such printers The use of electronically controlled printers of several kinds has grown rapidly. Continued decreases in costs and increases in performance suggests that this trend will continue.

The presence of various kinds of such printers in the marketplace is in response to the different requirements necessary to satisfy different segments thereof. One of these segments is the marketplace portion for label printers. Such printers print on "peel-away" labels adhering to a coated paper ribbon substrate stored usually by being wound into a roll. The coated paper substrate with the labels is fed between a pinch roller and a printing head along with an ink ribbon so that the print head may cause, by localized heating, a transfer of ink from the ribbon to a label thereagainst.

The ink ribbon is supplied from a roll of ink ribbon having a core with that ink ribbon wound thereabout. Information concerning the ink ribbon situation is often desired to use both by the operator, and by the control arrangement as a basis to make internal adjustments of parameters in the printer to obtain the best possible printing through taking into account varying ink ribbon conditions.

One known way for conveying such information to the printer control arrangement is to provide some coding scheme on the core of the ink ribbon roll through providing some markings thereon. These markings can be detected by directing light from an optical source onto a path containing the code markings and detecting the presence or absence of reflected light to an optical detector.

However, slippage between the roll of ink ribbon and the rotation support mechanism therefor can lead to errors in the optical sensing process. Similarly, such slippage can lead to smudging and smearing in the printing of the labels. Thus, there is desired a drive arrangement for the an ink ribbon roll which will avoid slippage.

SUMMARY OF THE INVENTION

The present invention provides a motor and drive mechanism having a drive hub which positively locks to the core for an ink ribbon roll through having engagement fingers to engage compartments in the core formed in part by walls against a corresponding one of which walls each finger is in contact. Some engagement fingers are in contact with a wall facing a particular direction of rotation while other engagement fingers are in contact with a wall facing oppositely to that direction of rotation to thereby provide a positive engagement of the core of the roll insofar as rotation in either direction is concerned. This core is used to form a "take-up" ink ribbon roll on the drive hub. A similar arrangement is used with a drag hub to which a supply ribbon roll is engaged, the drag hub being mounted on a spindle to which a drag mechanism is connected to oppose rotation thereof. A ribbon roll for either hub has a core formed of concentric cylindrical shells separated from one another by support walls to provide the compartments. The ribbon is wound about the outer shell, and one or more coding marks are provided on this shell to indicate both the printer control system and, to a visual observer, information specific to the ribbon.

DETAILED DESCRIPTION OF THE PREFERRED EMBODIMENTS

Figure 1:
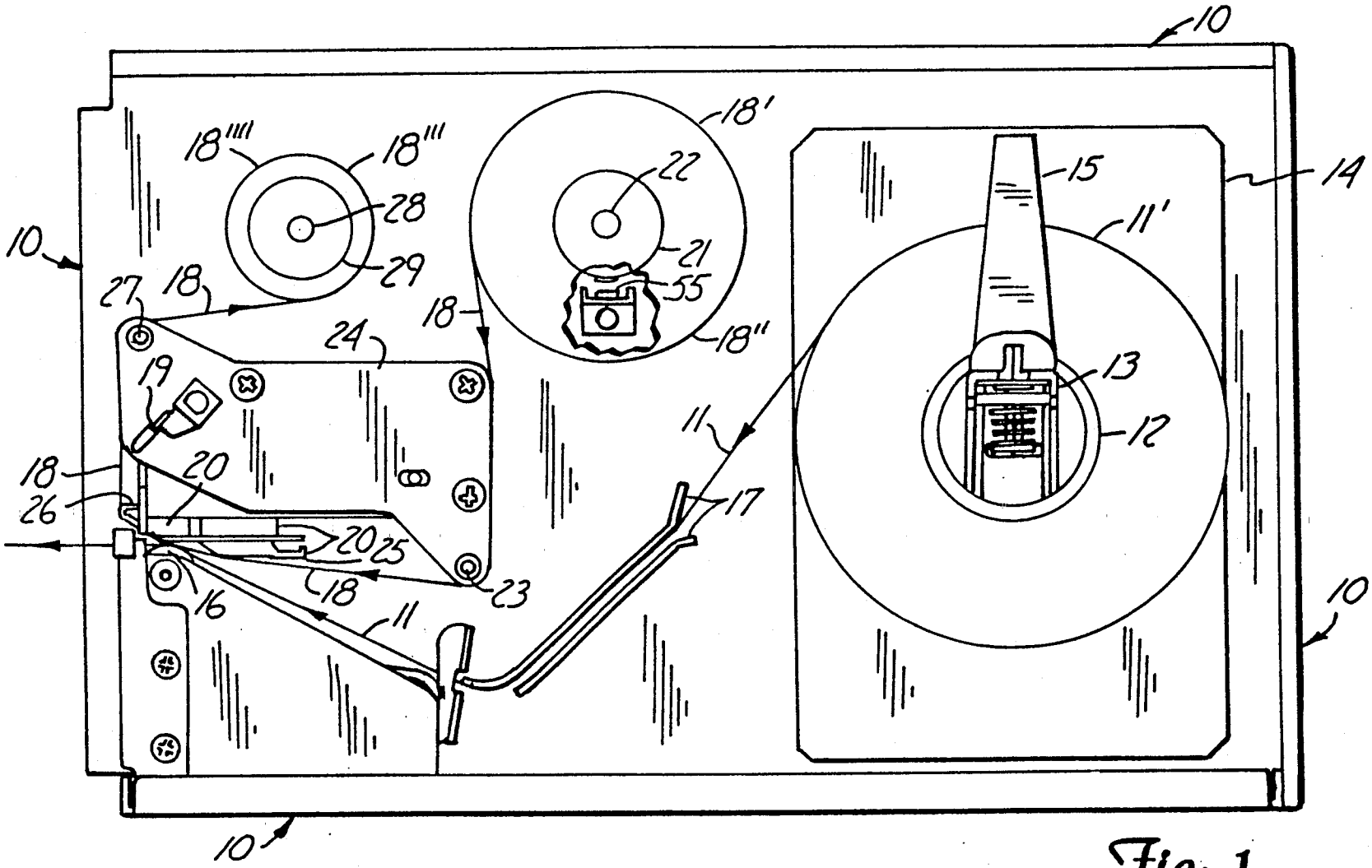
FIG. 1 shows a side view of a structure embodying the present invention.

FIG. 1 shows a side view of the interior operating portions of a label printer. A frame, 10, provides support for the various components of the label printer system. A store of blank labels is provided on a coated paper substrate such that they together form a web, 11, wound into a roll, 11', about a core, 12, which is mounted on and supported by a support bar, 13.

Core 12 and roll 11' formed from web 11 are locked against a side plate, 14, by an adjustable roll keeper, 15, but in such a manner as to allow roll 11' to turn as demanded by the rotation of a pinch roller, 16. Web 11 passes through a guide, 17, before reaching pinch roller 16. The rotation of pinch roller 16 is under the direction of a control system for the label printer, and is not shown in FIG. 1.

Web 11 is pressed against pinch roller 16, and an ink ribbon, 18, is pressed against that web across from pinch roller 16 by moving a lever, 19, as suitable to force a thermal print head, 20, against the side of ink ribbon 18 opposite that facing web 11. Rotating lever 19 in the opposite direction lifts thermal print head 20 to permit installation of ink ribbon 18 and web 11 between pinch roller 16 and that head.

Ink ribbon 18 is supplied from an ink ribbon roll, 18', having an ink ribbon supply, 18'', wrapped about a core, which cannot be seen in FIG. 1 because of the use of a drag support hub, 21, over the end of the core to support roll 18' about an end of a support spindle, 22. Ribbon 18 is then passed around a roller, 23, mounted in a thermal printer head support structure, 24. This ink ribbon continues over a protective cover structure, 25, protecting other parts of thermal print head 20 in being mounted thereon and further guides the ribbon. Ink ribbon 18, after emerging from between pinch roller 16 and thermal print head 20, passes over a plate, 26, with a rolled edge, and then over another roller, 27. Both rolled edge plate 26 and roller 27 are mounted in support structure 24.

A similar arrangement is used at the end of a drive shaft, 28, in connection with a "take-up" roll, 18''', in which used ink ribbon portions, 18'''', are accumulated through being wound about a core, not seen in FIG. 1, because of rotational force being applied to that core. Again, this hiding of the core in roll 18''' is due to the use of a support hub, drive support hub 29, to support the end of roll 18''' about drive shaft 28 to keep the roll concentric with that drive shaft.

Figure 2:
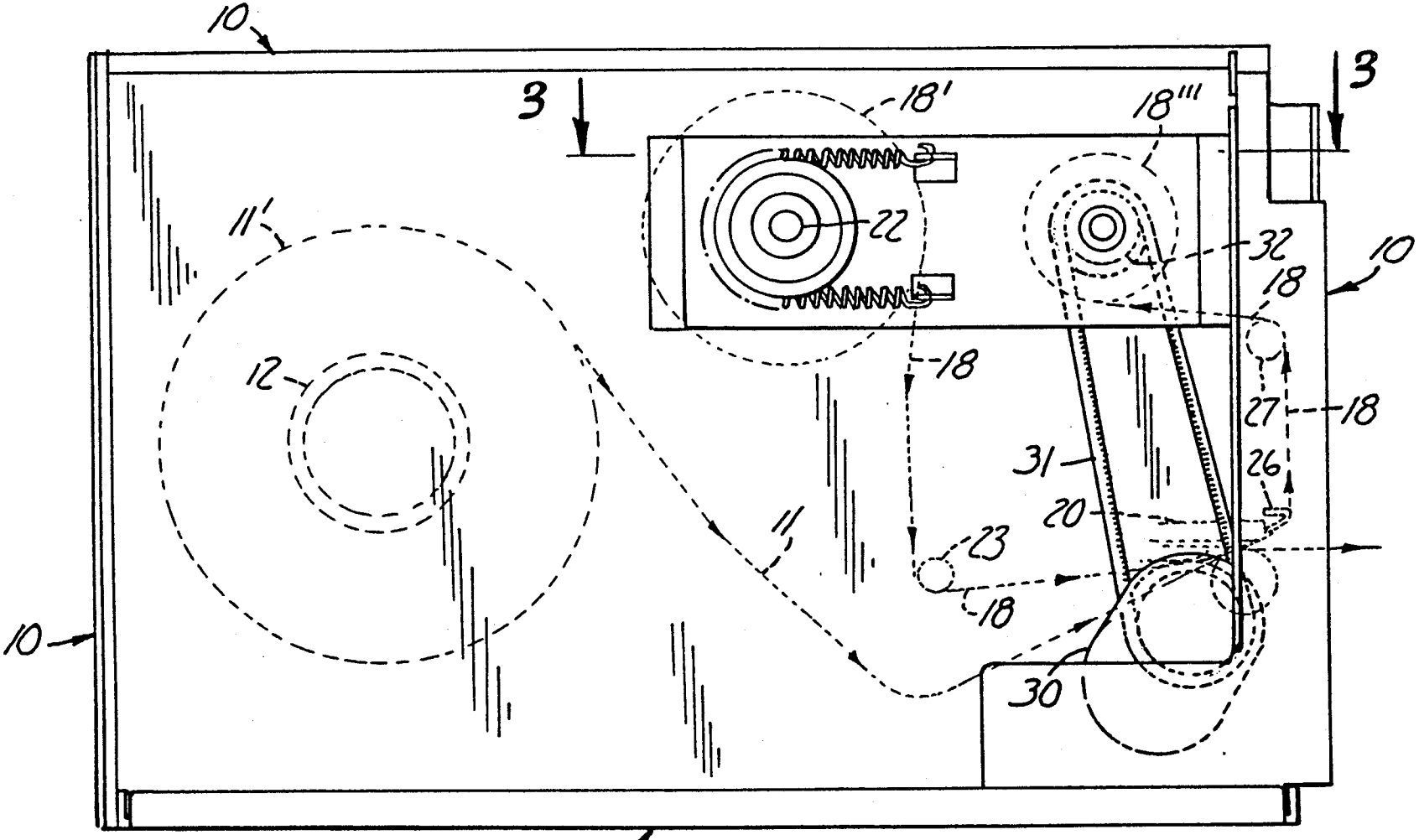
FIG. 2 shows a side view opposite that of FIG. 1 of the structure embodying the present invention.

FIG. 2 shows a side view of the same structure shown in FIG. 1 but from the opposite side. Certain of the structural components, the unused supply 11' for web 11 about core 12, the supply spool 18' and the "take-up" spool 18''' for ink ribbon 18 are shown in dashed line form in FIG. 2 due to there being hidden by the vertical portions of frame 10. Also shown in FIG. 2 are arrows in the paths of web 11 and ink ribbon 18 indicating the directions of travel for them. Electronic circuit boards and components, and other electrical components, used to implement the control system for the label printer are in practice mounted on the side of the vertical portion of frame 10 shown in FIG. 2, and on the bottom portion of frame 10 on the FIG. 2 side of the vertical portion of that frame. However, these electronic circuits and components have been omitted in FIG. 2 so that the dashed line views of the selected items provided on the opposite side of the vertical portion of frame 10 can be more clearly seen in that figure.

Figure 3:
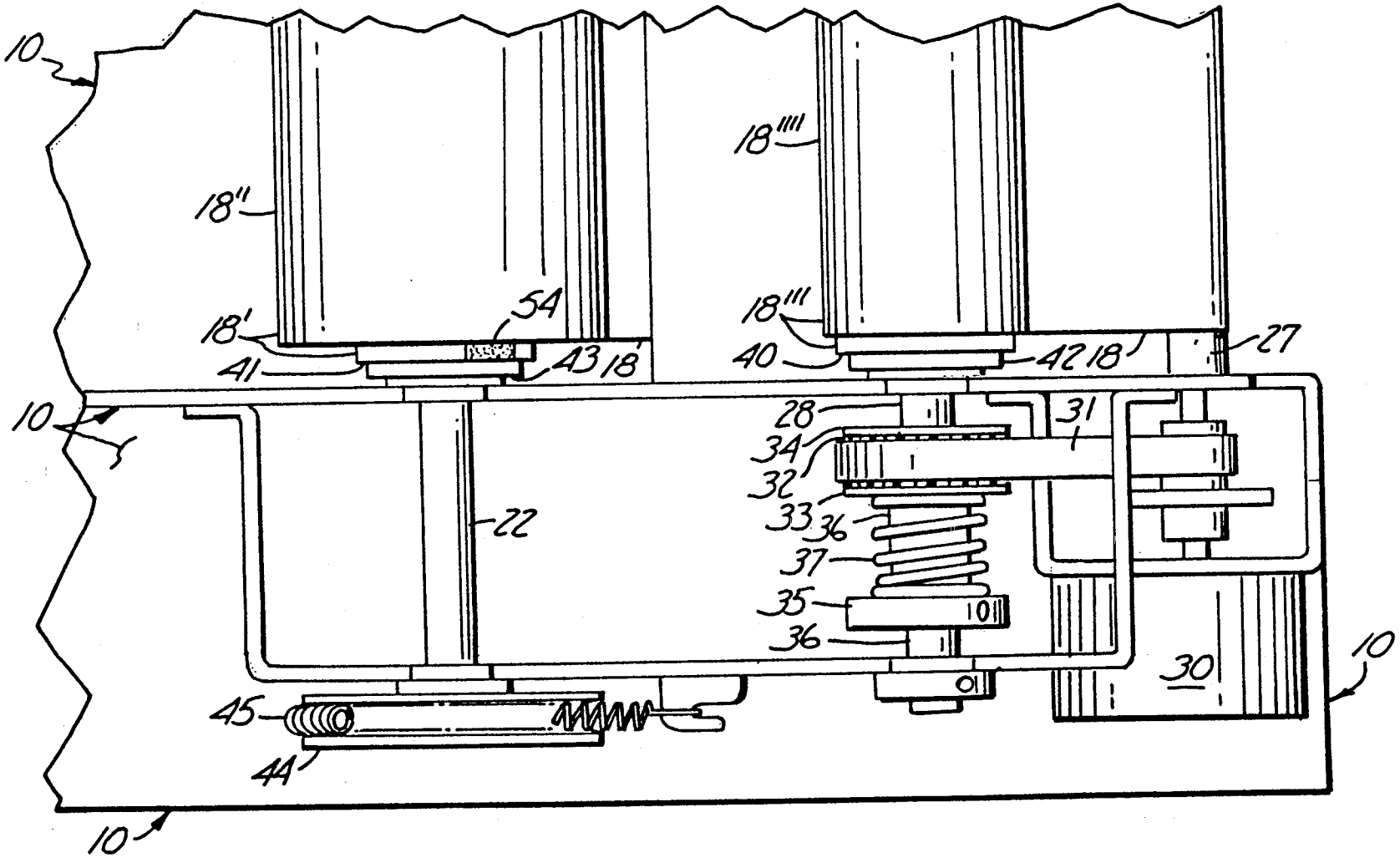
FIG. 3 shows a fragmentary cross section from the top of the structure shown in FIGS. 1 and 2.

In addition, FIG. 2 shows some portions of the drive system for moving ink ribbon 18 from supply roll 18' to "take-up" roll 18'''. An electric motor, 30, under control of the control system for the label printer, is used to selectively rotate a drive belt, 31. Belt 31, in turn, drives a friction drive ring, 32, which is captured between two friction plates, 33 and 34 to form a clutch, as is best seen in the fragmentary cross section view from FIG. 2 shown in FIG. 3, giving a top view of the structure shown in FIG. 2. The friction established between ring 32 and friction plates 33 and 34 is set by the side forces exerted on friction plate 33. These side forces are provided by (a) the location at which a spring retainer ring, 35, is affixed to a rotatable shaft, 36, passing through a concentric opening in friction plate 33, and (b) a spiral clutch spring, 37, positioned about shaft 36 between ring 35 and plate 33, with shaft 36 has its end past ring 35 supported in frame 10.

Friction plate 33 is forced against frictional drive ring 32 which in turn is forced against friction plate 34 to rotate drive shaft 28 supported in frame 10 to in turn rotate "take-up" roll 18''' on the opposite side of frame 10 to thereby accumulate used ribbon portions 18'''' around a core, 40, in roll 18'''. That is, "take-up" roll 18''' comprises core 40 having used ribbon portions 18'''' wound therearound.

Ink ribbon supply spool 18' similarly comprises unused ink ribbon portions 18'' wrapped about a core, 41. The rotational driving of "take-up" roll 18''' by motor 30 establishes a tension in ink ribbon 18 to draw unused portions of ribbon 18 from supply roll 18' past pinch roller 16 and thermal print head 20.

Such rotational driving of "take-up" roll 18''' is accomplished by drive shaft 28 being rotated by motor 30 through the clutch to in turn rotate a drive hub, 42, affixed to that shaft and engaged with core 40 to thereby force roll 18''' to rotate. Ink ribbon supply roll 18', being rotated by the tensile force transmitted in ink ribbon 18 by the rotation of "take-up" roll 18''', is kept from rotating freely which could lead to uncontrolled oscillations in both rate and position thereof. This is accomplished by having that roll coupled to spindle 22 through a drag hub, 43, affixed to spindle 22 and engaged with core 41 of the roll. Spindle 22 extends from drag hub 43 through portions of frame 10 into a pulley, 44, having a drag spring, 45, wrapped therearound with the two ends of this spiral spring being affixed to frame 10 to place that spring under tension. Such a spring force on pulley 44 acts to retard somewhat the rotation of that pulley and so of spindle 22.

The use of the clutch formed by drive ring 32 and friction plates 33 and 34 allows drive shaft 28 to turn at an increasingly slower speeds as used portions of ribbon 18 are accumulated in "take-up" roll 18'''. The increasing diameter of accumulated used ribbon portions 18'''' on core 40, and the tension in ink ribbon 18 due to the drag force on supply spool 18' during driven rotation of roll 18''', lead to increasing slippage in the clutch to thereby slow the rotation rate of roll 18''' as it increases in diameter. This allows keeping the speed of ribbon 18 past pinch roller 16 and thermal print head 20 relatively constant despite the changing diameters of "take-up" roll 18''' and supply roll 18'.

Figure 4A:
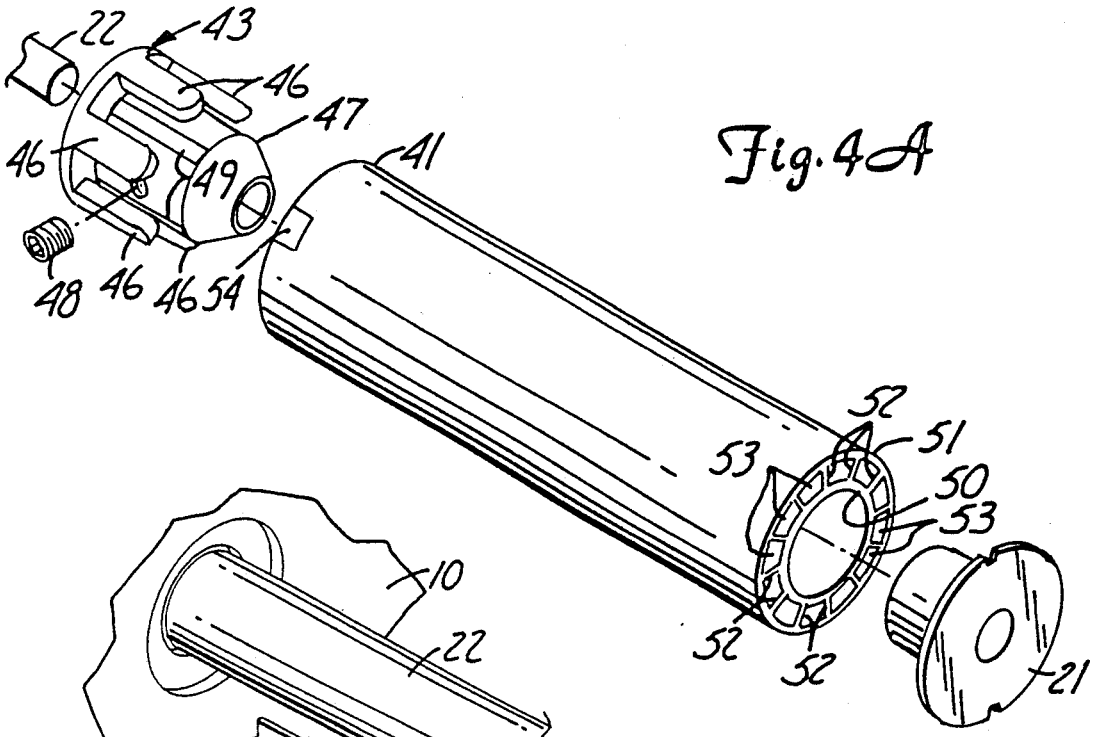
FIG. 4A shows an exploded view.
Figure 4B:
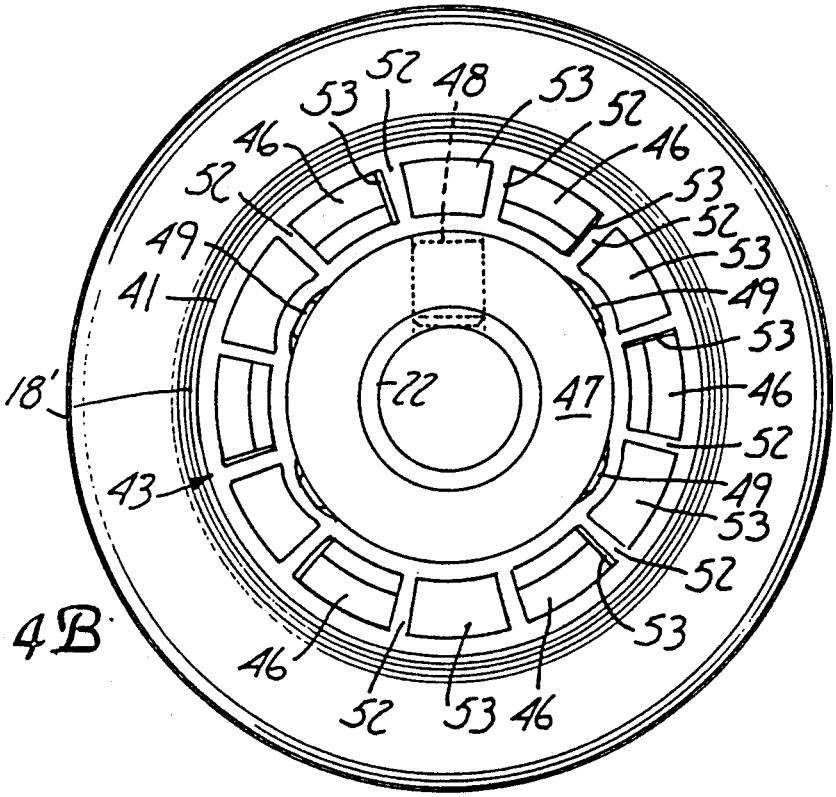
FIG. 4B shows an end view, of a portion of the structure shown in the previous figures.

FIG. 4A shows an exploded view of an empty supply roll 18', that is, showing just core 41 without any supply ribbon 18'' shown stored thereon, and spindle 22, drag hub 43 and drag support hub 21. FIG. 4B shows an end view of supply roll 18' mounted on drag hub 43. The arrangement of "take-up" roll 18''' and its core 40, drive shaft 28, drive hub 42 and drive support hub 29 are identical with the structure shown in FIGS. 4A and 4B with the possible exception of a coding mark on that core as will be described below.

Drag hub 43 is shown having six engagement fingers, 46, each joined at the inside end thereof, adjacent spindle 22 in FIG. 4A, to a collar portion, 47, at a flat end thereof from which they each extend toward its opposite, beveled, end facing core 41 in that figure. Engagement fingers 46, except where joined at the flat end of hub 43 to collar portion 47, are otherwise separated from remaining portions of collar 47 as they extend toward the beveled end of hub 43 substantially parallel to the center axis thereof extending symmetrically through the center of the symmetrically positioned circular opening located at the center of, and extending through, that collar portion and through which spindle 22 passes when hub 43 is assembled thereon. Further, a set of four ridges, raised from collar portion 47, are each located between a corresponding pair of engagement fingers 46, and also extend substantially parallel to the center axis of drag hub 43. Collar portion 47 can be affixed to spindle 22 where it passes through the central opening therein by the use of a set screw, 48, as indicated in FIG. 4A. Drag hub 43 is formed of a rigid plastic such as "DELRIN".

Core 41, as well as core 43, are formed of a more flexible plastic, such as high impact polystyrene, through extrusion. Core 41 is formed of a pair of spaced apart, concentric cylindrical shells, an inner shell, 50, and an outer shell, 51. The spaced relationship between these shells is maintained by a dozen support walls, 52, located at approximately equal angles about the concentric axis of the two shells, and extending radially between these shells along portions of corresponding common radii thereof. Thus, these walls in effect form a dozen compartments, 53, between them running the length of the two shells forming core 41 substantially parallel to the common axis of the shells.

As can be seen in FIG. 4B, the separation between engagement fingers 46 and collar portion 47 is sufficient to permit inner cylindrical shell 50 to pass between parts of fingers 46 and part of collar portion 47 such that these fingers enter corresponding ones of compartments 53, these being every other one of compartments 53. As can be further seen in FIG. 4B, the sectoral widths of fingers 46, or the angle subtended by the side of each finger with respect to the center axis of collar portion 47, together with the tolerances in the placements of support walls 52, result in some of engagement fingers 46 contacting a support wall 52 on the side of a compartment differing from the side contacted by others of fingers 46. That is, if a counterclockwise direction of rotation is assumed as an example, some of engagement fingers 46 will be in contact with walls 52 that are facing that direction of rotation while the sides of others of engagement fingers 46 will be in contact with walls facing oppositely and so away from that direction of rotation. Hence, core 41 will be positively "locked" to drag hub 43 no matter which direction of rotation is chosen therefore. In addition, this "locking" is further enhanced by raised ridges 49 being forced under empty ones of corresponding compartments 53 to thereby distort inner cylindrical shell 50 into slightly invading such compartments, as can be seen in FIG. 4B.

Such slip-free joining of "take-up" roll core 41 to drag hub 43, and supply roll core 40 to drive hub 42, is important because variable or excessive slippage between these cores and hubs can lead to smearing or smudging of printing on the labels printed by thermal printer head 20 under direction of the printer control system to be supplied to users. In addition, any such slippage between core 41 and drag hub 43 can also cause jitter problems, with possible resulting errors, in the detection system used in connection with a reflective coding mark, 54, provided on the outer surface of outer cylindrical shell 51 at the end of core 41 at which drag hub 43 is engaged thereto.

Figure 5:
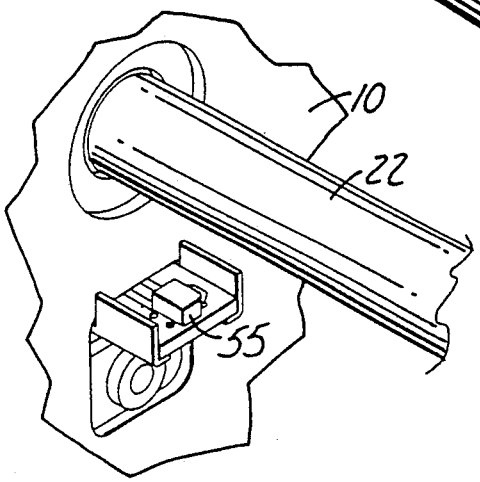
FIG. 5 shows a fragmentary view of a portion of the structure shown in the previous figures.

One or more coding marks can be placed here which alter (typically increase) the reflectivity of a light beam incident thereon relative to the reflectivity of the plastic material forming the outer surface of outer cylindrical shell 51. A fragmentary view is shown in FIG. 5 of that portion of the printer structure in FIG. 1 where spindle 22 passes through frame 10 to have drag hub 43 mounted thereon for engaging a core 41. Both this hub and the core are omitted in FIG. 5 so that the optical detector arrangement, 55, mounted below spindle 22 can be seen. Photodetector arrangement 55 has a source for providing a beam of light and a photodetector for detecting reflected portions of that beam from the end of a core 41, either from the outer plastic surface of outer cylindrical shell 51 or from coding mark, or marks, 54 thereon.

The frequency at which a coding mark 54 passes by optical sensing arrangement 55 is a measure of the rotation speed of that core 41 on which it is provided. The difference between the rotation rate of a core 41 at any given time, and the maximum rotation rate which it can achieve given the rotation rate of drive shaft 28, is a measure of the ink ribbon 18'' remaining on the spool 18'. Further, the width of the mark, for instance, can be used to indicate the type of ink ribbon 18'' present in spool 18'. In this regard, coding mark 54 can also be color coded to provide the same information to an operator through visual inspection. Thus, the type of ribbon can be sensed by the control system using such coding marks as a basis for optimizing the print quality through adjustment of thermal printing parameters.

Figure 6:
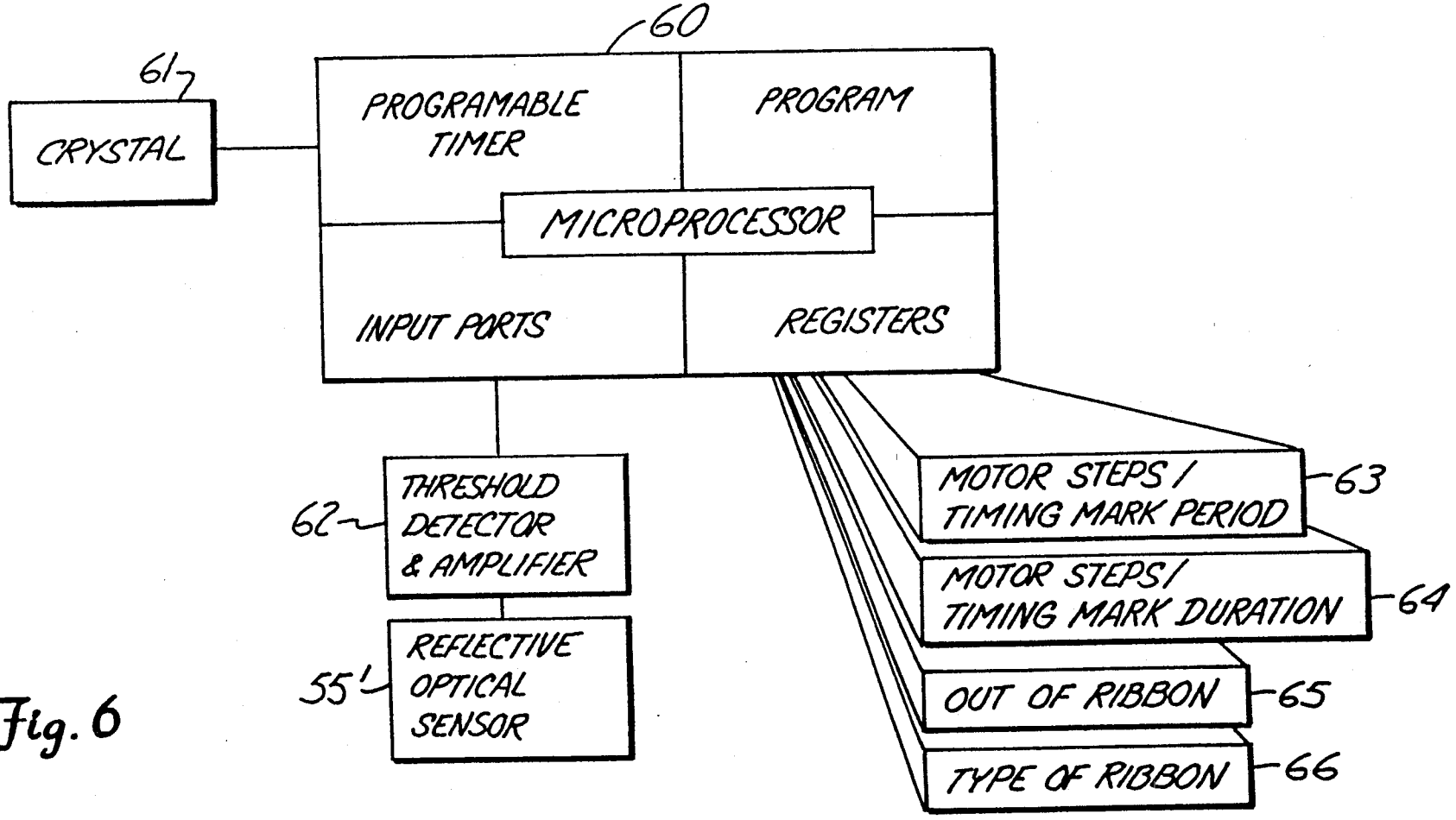
FIG. 6 is a block diagram of a portion of the control system used in the structure shown in the previous figures.

FIG. 6 shows a portion of the control system for a label printer having a microprocessor, 60, using a timing base set by a crystal, 61, as part of a crystal oscillator. The sensor portion, 55', of optical sensing arrangement 55 is shown providing its output signal to a threshold detector and amplifier means, 62. Detector and amplifier 62 provides the output thereof to input ports of microprocessor 60 where these signals are used in connection with a program residing in microprocessor 60 to provide information of the type described above for storage in registers in microprocessor 60. That is, these registers store information as to the frequency of passage of the timing mark in a register, 63, and the duration of the mark during such passages to obtain its width in a register, 64. From this, microprocessor 60 can determine an out of ribbon condition providing an indication of that situation in a further register, 65. Similarly, the type of ribbon can be determined by microprocessor 60 and stored in a further register, 66. The information in these registers can then be consulted by microprocessor 60 in setting related printer parameters.

Although the present invention has been described with reference to preferred embodiments, workers skilled in the art will recognize that changes may be made in form and detail without departing from the spirit and scope of the invention.

What is claimed is:

1. A ribbon spool drive system for rotating spool cores having ribbons wrapped therearound about an axis of the core, said cores each formed by inner and outer cylindrical shells concentric about and extending along said axis and spaced apart from one another by a plurality of support walls dividing the space therebetween into three or more compartments extending along said axis with said support walls being separated approximately equally from one another, said drive system comprising:

a motor having an output means operatively coupled thereto for selectively rotating said output means;

a drive shaft connected at one end thereof to said motor output means; and a drive hub means having a collar portion affixed about said drive shaft and having at least three engagement fingers joined to, but in part spaced away from, said collar portion such that said core is mounted on said drive hub means through said inner cylindrical shell being slid over part of si collar portion with said engagement fingers extending into corresponding ones of said compartments in said core, said engagement fingers each having a pair of sides extending approximately along said axis which between them with respect to said axis, subtend an angle such that the two sides on each of said fingers contact support walls in said core.

2. The apparatus of claim 1 wherein a said side of one of said engagement fingers contacts a said wall portion of a said core, mounted thereon, which faces a selected directing of rotation of said core by said drive system, and another side of another of said engagement fingers contacts a said wall portion facing opposite said selected direction of rotation.

3. The apparatus of claim 2 wherein said drive hub means has extending out from said collar portion a plurality of elongated ridge portions extending approximately parallel to said engagement fingers and each located between a pair of said engagement fingers.

4. The apparatus of claim 1 further comprising a support hub on said drive shaft which engages said core when mounted on a said drive hub means.

5. The apparatus of claim 1 wherein said drive hub means has six engagement fingers.

6. The apparatus of claim 1 wherein said drive hub means has extending out from said collar portion a plurality of elongated ridge portions extending approximately parallel to said engagement fingers and each located between a pair of said engagement fingers.

7. The apparatus of claim 1 wherein said output means includes spring loaded clutch to coupled rotatory motion of said motor means to said drive shaft.

8. The apparatus of claim 1 further comprising a drag hub means having a collar portion and a spindle affixed thereto, said hub means having at least three engagement fingers joined to but in part spaced away from said collar portion such that said core is mounted on said drag hub means through said inner cylindrical shell being slid over part of said collar portion with said engagement fingers extending into corresponding ones of said compartments in that core, said engagement fingers each having a pair of sides extending approximately along said axis which between them with respect to said axis, subtend an angle such that the two sides on each of said fingers contact support walls in said core.

9. The apparatus of claim 8 wherein said spindle has a drag means connected thereto introducing a selected frictional force opposing rotation of said spindle.

10. The apparatus of claim 8 and including an optically readable mark on said core and an optical sensing system positioned below said spindle to sense said mark on said core passing thereover.

11. The apparatus of claim 10 and including a control system and wherein said optical sensing system provides output signals to said control system which determines the amount of ribbon remaining based on a difference in current rotation rate of said core and the maximum rate of rotation possible for said core.

12. The apparatus of claim 10 and including a control system and wherein said optical sensing system provides output signals to said control system which determines the type of ribbon on a core on said spindle by duration of presence of said mark in a rotation of said core.

13. The apparatus of claim 8 wherein a said side of one of said drag hub mean engagement fingers contacts a said wall portion of a said core, mounted thereon, which faces a direction of rotation of said core, and another side of another of said engagement fingers contacts a said wall portion facing opposite said direction of rotation.

14. The apparatus of claim 8 further comprising a support hub on said spindle which engages said core when mounted on a said drag hub means.

15. The apparatus of claim 8 wherein said drag hub means has six engagement fingers.

16. The apparatus of claim 8 wherein said drag hub means has extending out from said collar portion a plurality of elongated ridge portions extending approximately parallel to said engagement fingers thereof and each located between a pair of said engagement fingers thereof.

* * * * *